US010384222B2

(12) United States Patent
Costa

(10) Patent No.: US 10,384,222 B2
(45) Date of Patent: Aug. 20, 2019

(54) PUMP ACTUATOR HEAD

(71) Applicant: ALBEA SERVICES, Gennevilliers (FR)

(72) Inventor: Lluis Costa, Farmington, CT (US)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 15/632,281

(22) Filed: Jun. 23, 2017

(65) Prior Publication Data

US 2018/0369845 A1 Dec. 27, 2018

(51) Int. Cl.
*B05B 11/00* (2006.01)

(52) U.S. Cl.
CPC ..... *B05B 11/3059* (2013.01); *B05B 11/3047* (2013.01); *B05B 11/3001* (2013.01)

(58) Field of Classification Search
CPC ..... B05B 11/3001; B05B 11/3047; B05B 11/3059
USPC ..... 222/135, 137, 153.04, 153.13, 190, 222/321.7–321.9, 383.1, 383.2, 384
See application file for complete search history.

(56) References Cited

U.S. PATENT DOCUMENTS 3,422,996 A * 1/1969 Elmer ..... B05B 11/3059 222/384
4,369,899 A * 1/1983 Magers ..... B67D 7/0211 222/153.13
4,479,589 A * 10/1984 Ford ..... A47K 5/1201 222/153.13
4,991,746 A * 2/1991 Schultz ..... A47K 5/1205 222/153.13
6,065,647 A * 5/2000 Bliss, III ..... B05B 11/0029 222/153.02
D452,822 S * 1/2002 Boshuizen ..... D9/448
6,543,649 B1 * 4/2003 Danielo ..... B05B 11/3059 222/153.13
6,644,516 B1 * 11/2003 Foster ..... B05B 7/0031 222/190
7,802,701 B2 * 9/2010 Jahan ..... B05B 7/0037 222/153.13
8,079,497 B2 * 12/2011 Brouwer ..... B05B 11/3087 222/135
8,336,737 B2 * 12/2012 van der Heijden ..... B05B 11/0078 222/145.3

(Continued)

*Primary Examiner* — Vishal Pancholi
(74) *Attorney, Agent, or Firm* — Steven M. Greenberg, Esq.; Shutts & Bowen LLP

(57) ABSTRACT

The pump actuator head includes a base cap adapted for mounting on a container neck portion and provided with a central hole and a nozzle rotatably mounted on the base cap along an X-axis, and being movable between an operable or open position and an inoperable or closed position. The nozzle has a hollow cylinder centered along the X-axis, having a lower part inserted into the central hole of the base cap, and is provided with a guiding protrusion axially extending from the peripheral wall of the cylinder. The nozzle also has a dispensing nose extending from the cylinder and defining a dispensing channel. The base cap includes means provided in the inner face of the base cap for limiting or slowing the rotation of the nozzle. Finally, the guiding protrusion interferes with the means for limiting and for slowing down the rotation of the nozzle when turning the nozzle.

14 Claims, 6 Drawing Sheets

(56) References Cited

U.S. PATENT DOCUMENTS 8,608,031 B2 * 12/2013 Lasserre ..... B05B 11/3059
222/153.13
8,863,988 B2 * 10/2014 Kang ..... B65D 55/02
222/153.13

* cited by examiner

PUMP ACTUATOR HEAD

BACKGROUND OF THE INVENTION

Field of the Invention

The invention relates to a pump actuator head and a fluid dispenser having such a pump actuator head.

Background of the Invention

A fluid dispenser may include a pump actuator head with which fluid is pumped from the fluid dispenser. The fluid can be for example liquid, or foamy, or viscous. Specifically, the fluid is typically contained in a container having a pump actuator head that is depressed to dispense the product onto the hand of the consumer. The containers can be a wide variety of shapes, and there are different actuator heads and pumping means available, but the dispensers all operate on similar principles, with the actuator head being depressed, the product being drawn up a feed pipe and dispensed through a nozzle in the actuator head onto the user's hand in the case of a cream or a liquid soap for instance, or in the air for a perfume or a nasal spray for example.

The nozzle is rotatable between an open or operable or unlock position in which the fluid can be dispensed, or a closed or inoperable or lock position. A sign is provided on the head or on the dispenser to indicate to a consumer whether the actuator head is in an open or closed position, and in which direction it is necessary to rotate the head to move it from a closed to an open position, and vice versa. The rotation of the nozzle is generally limited by abutment means, as explained below.

It is known that the head includes a fixed base cap mounted on the neck of a container, the nozzle being rotatably mounted on this base cap along a dispensing axis. The nozzle includes a protrusion and the base cap includes ribs arranged on both sides of the protrusion so that the protrusion comes into contact with a first rib when turning the nozzle to the open position, and comes into contact with a second rib when turning the nozzle to the closed position. These two ribs act like abutment means. The interference between the protrusion and the ribs provides the consumer with a perception of resistance that translate an indication of hard stop that limits unwanted rotation when the nozzle is turned in either direction.

However, the nozzle can often be "easily" rotated, overriding the closed and open position and falling in between of an additional set of ribs, providing thus misleading indication of nozzle-base cap location. More precisely, the resistance generated when the protrusion deforms to go over the stopping axial ribs is not enough to provide a good sense of resistance to be perceived by the user as a reasonable positive stop.

To find again the good position of the nozzle for dispensing the fluid, the user has to force the rotation of the nozzle to override the ribs one after the other until he finds the unlock position (i.e. open position) where the nozzle axially translate when depressed.

SUMMARY OF THE INVENTION

The object of the invention is to propose a pump actuator head where the rotation of the nozzle from the open to the closed position, and vice versa, is clearly limited without any risk of ending up in a mistaken position between the nozzle and the base cap, and without amending the structure of the nozzle and the base cap.

The present invention solves the above technical problem with a pump actuator head typically including:

a base cap adapted to be mounted on a container neck portion, and being provided with a central hole;

a nozzle rotatably mounted on the base cap along an X-axis, and being movable between an operable or open position and an inoperable or closed position, the nozzle having:

a hollow cylinder centered along the X-axis, having a lower part inserted into the central hole of the base cap, and being provided with a guiding protrusion axially extending from the peripheral wall of the cylinder;

a dispensing nose extending from the cylinder and defining a dispensing channel;

The base cap includes means provided in the inner face of the base cap for limiting the rotation of the nozzle and/or means provided in the inner face of the base cap for slowing down the rotation of the nozzle;

the guiding protrusion being designed to interfere with the means for limiting and for slowing down the rotation of the nozzle.

The pump actuator head is characterized in that it includes means for reinforcing the guiding protrusion for limiting and for slowing down the rotation of the nozzle.

Thus, additional mechanical resistance is provided to the guiding protrusion to increase the required torque to override the means for limiting and for slowing down the rotation of the nozzle. As the resistance of the guiding protrusion is increased, the user will better perceive the limits of the rotating movement of the nozzle.

According to the invention, the means for reinforcing the guiding protrusion consists of a reinforcing ring designed to be inserted into the lower part of the cylinder.

Since the thickness of the guiding protrusion is not suit to be increased as per the current conception of it, the proposal is adding an additional component that will provide such structural strengths. This additional component is the ring, that enters into the cylinder, and that corresponds to the shape of the cylinder, and particularly the shape of the guiding protrusion. Instead of increasing the thickness of the guiding protrusion itself, the idea is to add a component so that the total thickness at the location of the guiding protrusion (i.e. thickness of the guiding protrusion+thickness of the ring) is increased.

According to different embodiments, that can be taken together or separately:

- the ring includes a projection axially extending from the peripheral wall of the ring, and designed to fit into the guiding protrusion to reinforce it: as the cylinder is hollow, the guiding protrusion is formed by a thin wall, whereas the ring is massive and its projection fill in the guiding protrusion.
- the means for limiting the rotation of the nozzle consists of at least two ribs extending axially from the inner face of the base cap, the guiding protrusion abutting against one of the ribs when turning the nozzle: thanks to the ring, the guiding protrusion will be less deformed, and will remain flatten against the ribs and won't go over them.
- the guiding protrusion has one front face delimited by two side faces.
- the projection of the ring has a font face in contact with the front face inner surface of the guiding protrusion, and delimited by two side faces in contact with the two side faces inner surfaces of the guiding protrusion.

the cylinder of the nozzle is provided with an inner tube adapted to accommodate a pump device, the ring having a central orifice with a diameter equal or greater than the inner diameter of the tube: the dispensing pipe of the pump can thus be inserted through the ring and the tube.

the ring includes an upper surface with an annular edge delimiting the central orifice and directed upwardly towards the dispensing nose, the free end of the inner tube of the cylinder resting on the edge.

the base cap includes an upper inner flange delimiting the central hole and being provided with a groove for accommodating the guiding protrusion of the nozzle in the open position in order to allow an axial displacement of the nozzle, the guiding protrusion of the nozzle having a radial cut off that engages with the upper inner flange of the base cap when turning the nozzle in the closed position in order to prevent any axial displacement, the radial cut off delimitating a tongue from the principal part of the guiding protrusion.

the means for slowing down the rotation of the nozzle consists of a bump protruding off the lower side of the upper inner flange of the base cap, the upper surface of the tongue going over the bump providing resistance the customer perceives as indication of going from the closed to the open position of the nozzle: there is a little friction between the bump and the tongue.

the upper surface of the projection of the ring goes over the bump: the upper surface of the ring is flush with the upper surface of the tongue. There is a high friction between the bump and the ring. This supplementary friction involves a higher mechanical resistance when rotating the nozzle, and slow down the rotation of the nozzle. This provides resistance the customer perceives as indication of going from one state to the other (i.e. closed and open position). As a result, the nozzle is not "too easy" to unlock and cannot happen spontaneously within a bag/purse leading towards accidental actuation and/or leakage.

the ring is composed of a rigid material as polypropylene.

The invention also concerns a manually actuated fluid dispenser that includes a container bottle having a neck portion, a pump and a pump actuator head as described above, mounted on the container neck portion.

BRIEF DESCRIPTION OF THE DRAWINGS

The invention will now be further described, by way of example only, with reference to the accompanying drawings, of which.

DETAILED DESCRIPTION OF THE PREFERRED EMBODIMENTS

Figure 1:
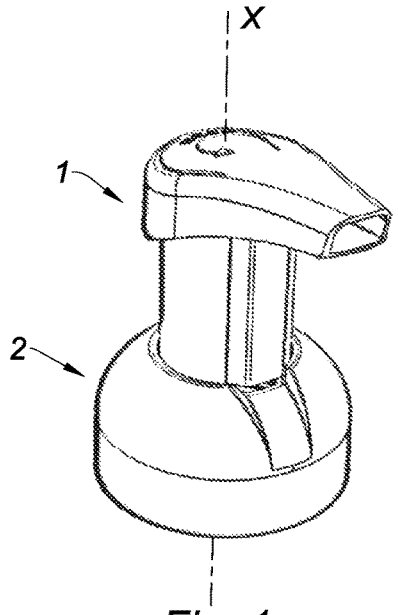
FIG. 1 shows a perspective view of a pump actuator head according to the invention, with the actuator head in an open position.

FIG. 1 illustrates a pump actuator head according to the invention.

This pump actuator head is mainly composed of a nozzle 1 rotatably mounted on a base cap 2 along an X axis.

Figure 3:
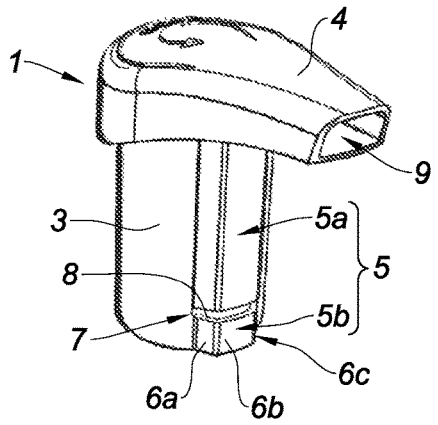
FIG. 3 shows the nozzle of the actuator head of FIG. 1.

The nozzle 1 is depicted in FIG. 3. It includes a hollow cylinder 3 centered along the X axis and being provided with a guiding protrusion 5 axially protruding from the peripheral wall of the cylinder 3. The guiding protrusion 5 extends on all the height of the cylinder 3. A radial cut off 7 is done in the guiding protrusion 5, so as to divide it into two parts, respectively a principal part 5*a* and a tongue 5*b*. The tongue 5*b* is located at a lower end of the cylinder 3. In this example, the cut off 7 is done at ¼ of the height of the cylinder 3, starting from the lower end.

The guiding protrusion 5 has a front face 6*b* and two side faces 6*a*, 6*c*.

The nozzle 1 also includes a dispensing nose 4 extending perpendicularly from the upper end of the cylinder 3 and defining a dispensing channel 9.

An arrow is quoted on the nose 4 and indicates to the consumer the direction of rotation to reach the open position of the nozzle 1.

Figure 4:
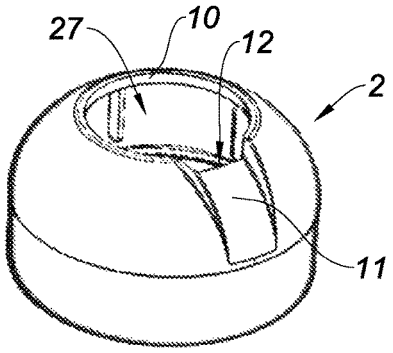
FIG. 4 shows the base cap of the actuator head of FIG. 1.

The base cap 2 is depicted in FIG. 4. It consists of a hollow piece of revolution, comprising a lower part with an inner thread adapted to be screwed on a neck of a container, and an upper part with a central hole 27 delimited by an upper inner flange 10. An axial groove 12 is cut on a section of the flange 10. An ramp 11 links the groove 12 and the lower part of the base cap 2.

The lower end of the cylinder 3 fits into the hole 27 of the base cap 2, with the guiding protrusion 5 inserted into the groove 12.

Figure 5:
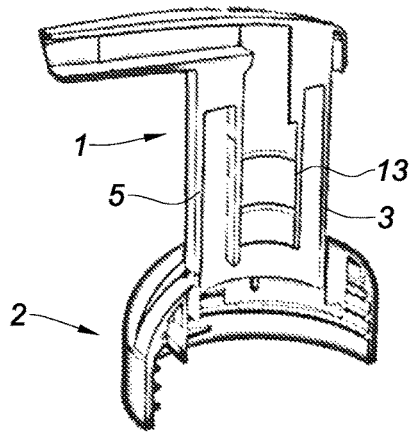
FIG. 5 shows a cross-sectional view of the actuator head in an open position.

In the open position or unlock position or operable position or dispensing position of the nozzle 1, the guiding protrusion 5 aligns with the groove 12, as depicted in FIGS. 1 and 5. In this position, the nozzle 1 can axially move relative to the base cap 2. The user can thus depress the nozzle 1 in order to dispense a dose of fluid contained in the container.

Figure 2:
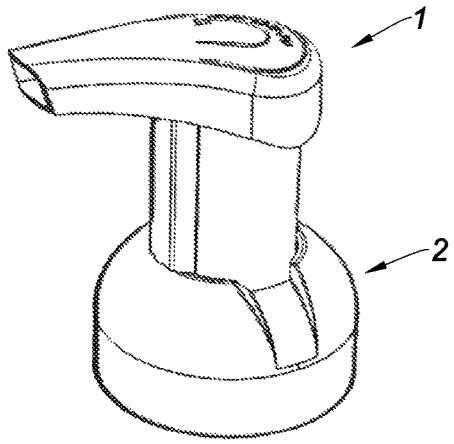
FIG. 2 shows a perspective view of a pump actuator head of FIG. 1 with the actuator head in a closed position.
Figure 6:
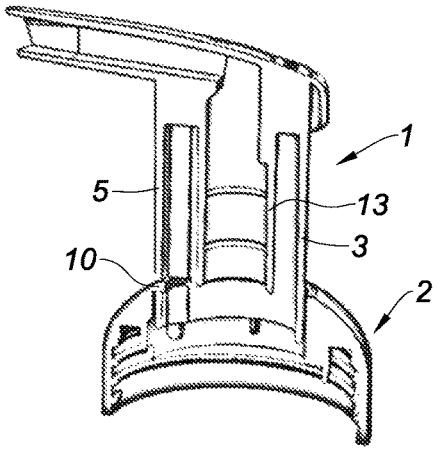
FIG. 6 shows a cross-sectional view of the actuator head in a closed position.
Figure 7:
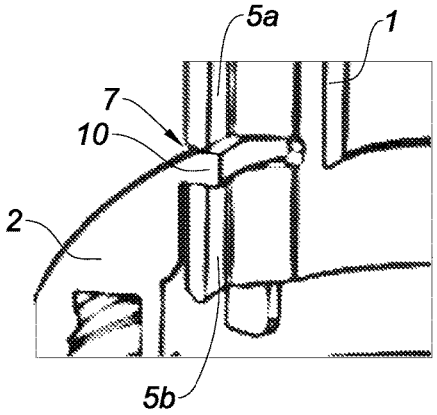
FIG. 7 is a detail of the junction between the nozzle and the base cap of the actuator head of FIG. 6.
Figure 8:
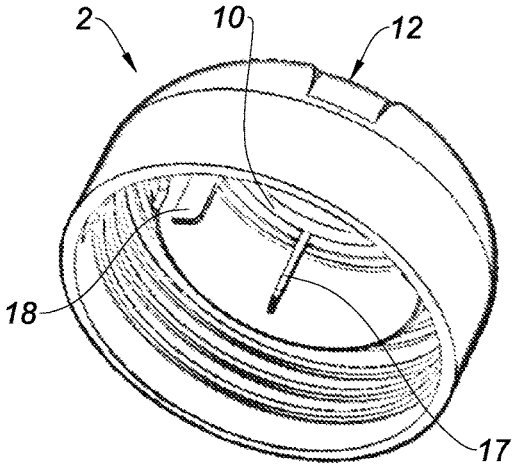
FIGS. 8 and 9 show perspective views of the inside of the base cap of FIG. 4.
Figure 9:
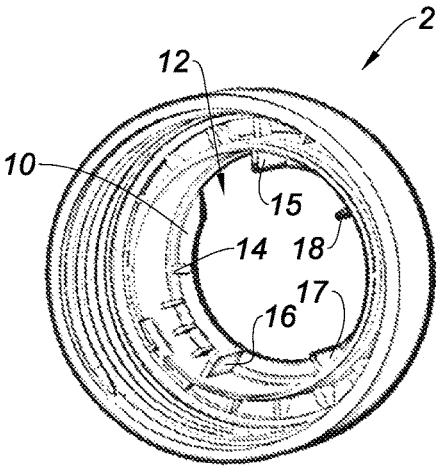

The nozzle 1 can be rotated from the unlocked position to a locked position, or closed position or inoperable position as depicted in FIGS. 2, 6 and 7. In this position, the cut off 7 of the guiding protrusion 5 engages with the flange 10 of the base cap 2, preventing any axial displacement of the nozzle 1 relative to the base cap 2.

The rotating movement of the nozzle 1 is limited by axial ribs 15,16,17,18 extending downwardly from the flange 10 of the base cap 2, as shown in FIGS. 8 to 11. The side walls 6*a*, 6*c* of the guiding protrusion 5 enters into contact with some of these ribs 15,16 when turning the nozzle 1.

Figure 10:
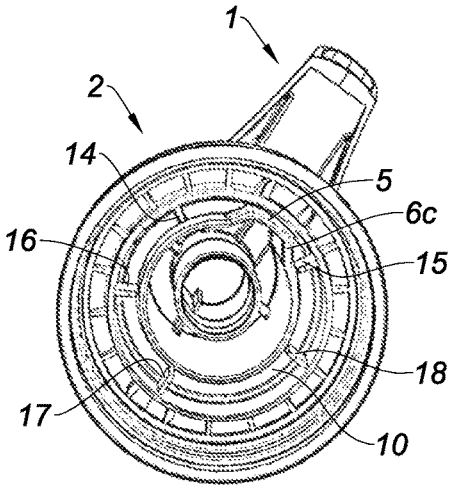
FIG. 10 shows a perspective view of the inside of the actuator head in an open position.

A first rib 15 is located right after the groove 12, on its right side, so as to interfere with the right side wall 6*c* of the guiding protrusion 5 when the nozzle 1 is in the unlock position, as shown in FIG. 10.

Figure 11:
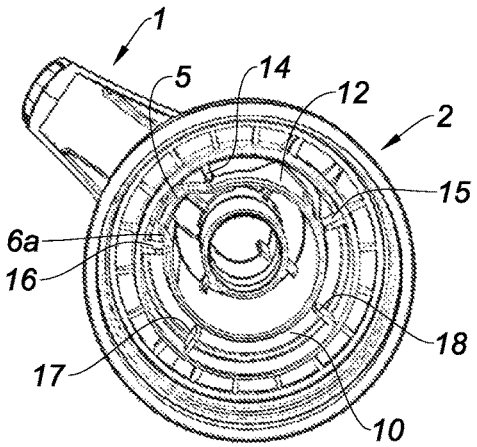
FIG. 11 shows a perspective view of the inside of the actuator head in a closed position.

A second rib 16 is located on the left side and at a distance of the groove 12, so as to interfere with the left side wall 6*a* of the guiding protrusion 5 when the nozzle 1 rotates clockwise, marking thus the lock position, as shown in FIG. 11.

Such interferences provide the consumer with a perception of resistance that translate on indication of hard stop that limits unwanted rotation when the nozzle 1 is turned in either direction.

An additional set of ribs 17,18 extends from the flange 10, and are arranged between the first rib 15 and second rib 16 on the sector of the flange 10 opposed to the groove 12.

When rotating to go from lock to unlock or vice versa, the upper surface 8 of the tongue 5*b* of the guiding protrusion 5 goes over a bump 14 protruding off the lower side of the flange 10 of the base cap 2, providing resistance the customer perceives as indication of going from one state to the other. The flexible nature of the upper surface 8 of the tongue 5*b* allows such overriding. The bump 14 is located right after the left side of the groove 12 of the base cap 2, so that the tongue 5*b* rubs against the bump 14 whenever the consumer rotates the nozzle 1. The rotation of the nozzle 1 is thus slowed down thanks to this bump 14. This bump 14 is also useful to maintain the nozzle 1 in the lock position, particularly when the consumer carries the whole dispenser, as it acts like a brake for rotating the nozzle 1.

It happens that the nozzle 1 can be too easily rotated, overriding the first and second ribs 15,16, and falling in between the additional set of ribs 17,18, providing misleading indication of nozzle 1-base cap 2 location. More precisely, the side faces 6*a*, 6*c* and front face 6*b* of the tongue 5*b* deforms too easily and passes over the ribs 15,16.

It also happens that the nozzle 1 can be too easily unlock, leading to accidental actuation and/or leakage. More precisely, the upper surface 8 of the tongue 5*b* deforms too easily and passes over the bump 14.

To solve these problems, a reinforcing ring 19 is inserted into the lower part of the cylinder 3 of the nozzle 1, so as to reinforce the profile of the tongue 5*b*. This ring 19 does not interact with any of the functions of the dispenser on which the head is mounted.

Figure 12:
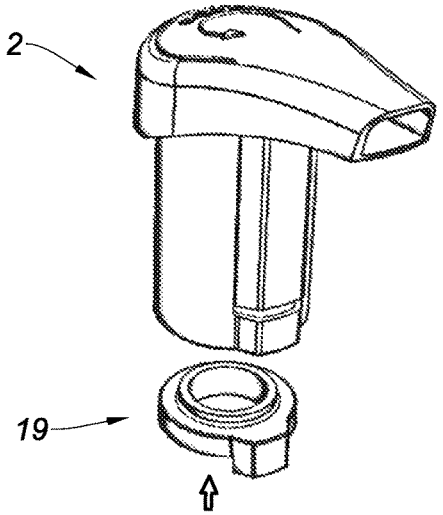
FIG. 12 is an exploded view of the actuator head with the ring.
Figure 13:
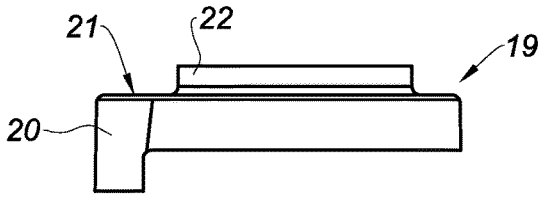
FIGS. 13 to 15 show different views of the ring.
Figure 14:
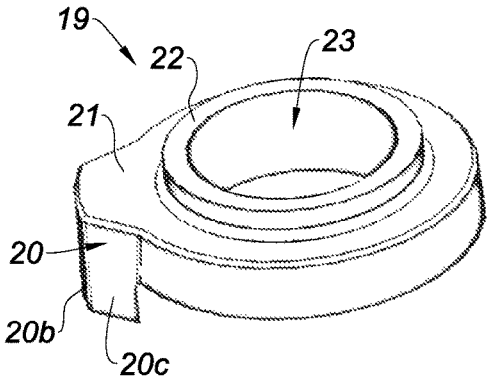
Figure 15:
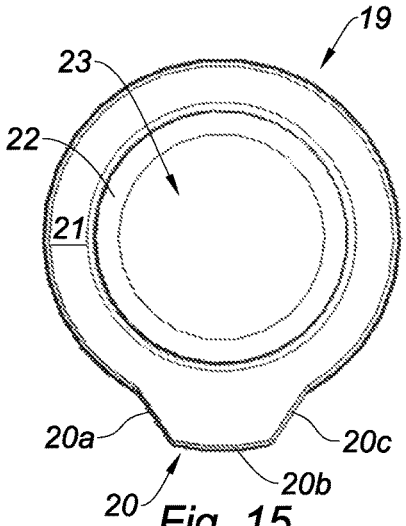
Figure 16:
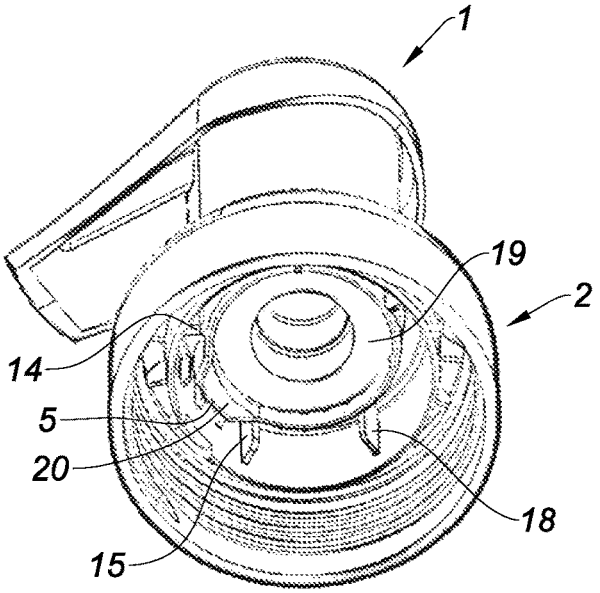
FIG. 16 shows a perspective view of the inside of the actuator head with the ring in position.

FIG. 12 illustrates the insertion of the ring 19 into the nozzle 1. The ring 19 is more clearly depicted in FIGS. 13 to 15.

The ring 19 is advantageously made of polypropylene, which is a material rigid enough to reinforce the tongue 5*b*. Other materials can be used.

The general shape of the ring 19 fits into the cylinder 3, as shown in FIGS. 16 to 21.

The ring 19 includes a projection 20 axially extending from the peripheral wall of the ring 19, and designed to fit into the tongue 5*b*. The projection 20 of the ring 19 has a front face 20*b* in contact with the inner surface of the front face 6*b* of the tongue 5*b*, and delimited by two side faces 20*a*, 20*c* in contact with the inner surface of the side faces 6*a*, 6*c* of the tongue 5*b*.

The projection 20 protrudes from the lower surface of the ring 19, so as to provide a height equivalent to the height of the tongue 5*b*.

Alternatively, the height of the ring 19 could be equivalent to the height of the tongue 5*b*.

The cylinder 3 of the nozzle 1 is provided with an inner tube 13 adapted to accommodate a pump device, the central orifice 23 of the ring 19 having a diameter equal or greater than the diameter of the tube 13.

Figure 17:
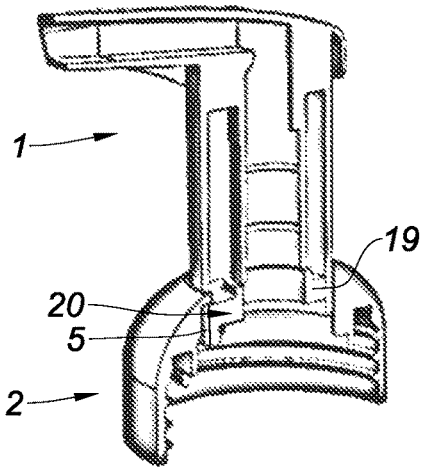
FIG. 17 shows a cross-sectional view of the actuator head in an open position with the ring.
Figure 18:
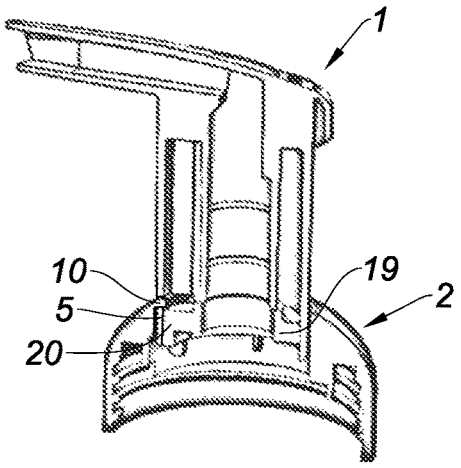
FIG. 18 shows a cross-sectional view of the actuator head in a closed position with the ring.

The ring 19 includes an upper surface 21 with an annular edge 22 delimiting the central orifice 23 and directed upwardly towards the dispensing nose 4, the free end of the inner tube 13 of the cylinder 3 resting on the edge 22 as depicted in FIGS. 17 and 18.

Figure 19:
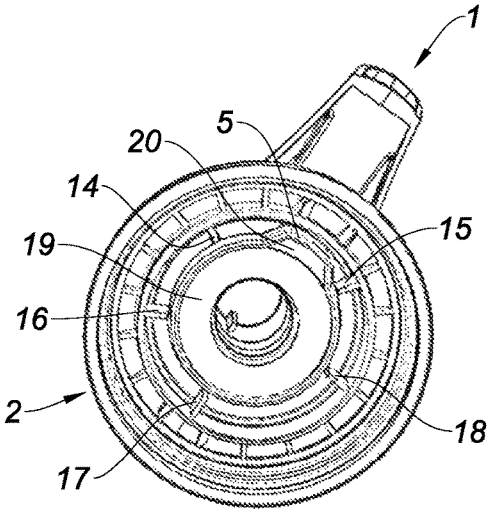
FIG. 19 shows a perspective view of the inside of the actuator head in an open position with the ring.

In the unlock position, in FIG. 19, the right face 6*c* of the tongue 5*b* abuts against the first rib 15. If the consumer goes on trying to turn the nozzle 1 to the right, the tongue 5*b* won't be deformed thanks to the rigidity of the ring 19, and the consumer will perceive a good sense of resistance, indicating a first reasonable positive stop.

Figure 20:
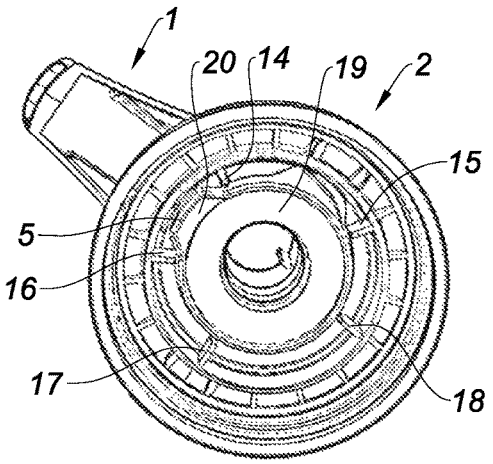
FIG. 20 shows a perspective view of the inside of the actuator head in a closed position with the ring.

When turning the nozzle 1 from the unlock to the lock position as illustrated in FIG. 20, the left face 6*a* of the tongue 5*b* abuts against the second rib 16. If the consumer goes on trying to turn the nozzle 1 to the left, the tongue 5*b* won't be deformed thanks to the rigidity of the ring 19, and the consumer will perceive a good sense of resistance, indicating a second reasonable positive stop.

In both cases, the ring 19 constraints the radial movement of the nozzle 1 when interfering 19 with the ribs 15,16.

Similarly, when turning the nozzle 1 from the lock position to the unlock position, and vice versa, the upper surface 8 of the tongue 5*b* rubs against the bump 14, as well as the upper surface 21 of the projection 20 of the ring 19 that rubs against the bump 14. This double friction enables to enhance the sense of resistance when going from one state to the other, and the consumer feels that he is changing the position. The upper surface 8 of the tongue 5*b* is not so much deformed thanks to the rigidity of the ring 19, and the bump 14 can efficiently act like a brake.

The ring 19 thus constraints the axial movement of the nozzle 1 when passing the bump 14.

Figure 21:
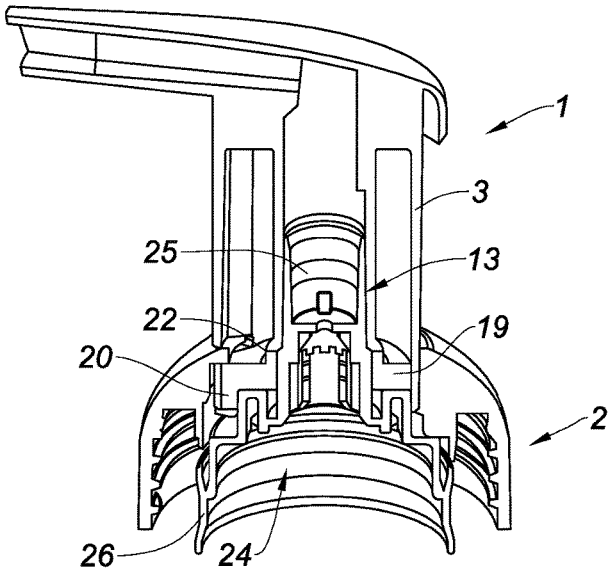
FIG. 21 shows the arrangement of a pump into the actuator head of the invention.

In FIG. 21, the head is mounted on a pump assembly 24 comprising a piston with a double sealing lip 26 and a dispensing pipe 25 inserted into the hole 23 of the ring 19 and into the inner tube 13 of the cylinder 3.

The ring 19 is arranged in a dead volume of the head so that is does not interfere with the positioning of the pump assembly 24 into the head.

Although the pump actuator head of the invention has been described above by reference to a specific embodiment shown in the drawing figures, it should be understood that modifications and variations could be made to the reinforcing ring 19 without departing from the intended scope of the following claims.

What is claimed is:

1. A pump actuator head comprising:

a base cap adapted to be mounted on a container neck portion, and being provided with a central hole;

a nozzle rotatably mounted on the base cap along an X-axis, and being movable between an operable or open position and an inoperable or closed position, the nozzle having:

a hollow cylinder centered along the X-axis, having a lower part inserted into the central hole of the base cap, and being provided with a guiding protrusion axially extending from a peripheral wall of the cylinder;

a dispensing nose extending from the cylinder and defining a dispensing channel;

the base cap comprising:

means provided in an inner face of the base cap either for limiting the rotation of the nozzle or for slowing down the rotation of the nozzle;

said guiding protrusion being designed to interfere by direct contact with said means for limiting and for slowing down the rotation of the nozzle;

wherein the pump actuator head includes means for reinforcing the guiding protrusion for limiting and for slowing down the rotation of the nozzle, wherein said means for reinforcing are located inside the hollow cylinder and reinforce the mechanical structure of walls defining/delimiting the guiding protrusion.

2. The pump actuator according to claim 1, wherein the means for reinforcing the guiding protrusion comprises a reinforcing ring designed to be inserted into the lower part of the cylinder.

3. The pump actuator according to claim 2, wherein the ring comprises a projection axially extending from a peripheral wall of the ring, and fitting into the guiding protrusion to reinforce it.

4. The pump actuator according to claim 3, wherein the means for limiting the rotation of the nozzle comprises at least two ribs extending axially from the inner face of the base cap, the guiding protrusion abutting against one of the ribs when turning the nozzle.

5. The pump actuator according to claim 4, wherein the guiding protrusion has one front face delimited by two side faces.

6. The pump actuator according to claim 5, wherein the projection of the ring has a front face in contact with an inner surface of the front face of the guiding protrusion, and delimited by two side faces in contact with inner surfaces of the two side faces of the guiding protrusion.

7. The pump actuator according to claim 2, wherein the cylinder of the nozzle is provided with an inner tube adapted to accommodate a pump device, the ring having a central orifice with a diameter equal or greater than the inner diameter of said tube.

8. The pump actuator according to claim 7, wherein the ring comprises an upper surface with an annular edge delimiting the central orifice and directed upwardly towards the dispensing nose, the inner tube of the cylinder having a free end resting on said annular edge.

9. The pump actuator according to claim 3, wherein the base cap comprises an upper inner flange delimiting the central hole and being provided with a groove for accommodating the guiding protrusion of the nozzle in the open position in order to allow an axial displacement of the nozzle, the guiding protrusion of the nozzle having a radial cut off that engages with the upper inner flange of the base cap when turning the nozzle in the closed position in order to prevent any axial displacement, the radial cut off delimitating a tongue from the principal part of the guiding protrusion.

10. The pump actuator according to claim 9, wherein the means for slowing down the rotation of the nozzle consists of a bump protruding off a lower side of the upper inner flange of the base cap, an upper surface of the tongue going over the bump providing resistance the customer perceives as indication of going from the closed to the open position of the nozzle.

11. The pump actuator according to claim 10, wherein the upper surface of the projection of the ring goes over the bump.

12. The pump actuator according to claim 2, wherein the ring is composed of a rigid material.

13. A manually actuated fluid dispenser comprising:

a bottle having a neck portion;

a pump; and, a pump actuator head comprising:

a base cap adapted to be mounted on a container neck portion, and being provided with a central hole;

a nozzle rotatably mounted on the base cap along an X-axis, and being movable between an operable or open position and an inoperable or closed position, the nozzle having:

a hollow cylinder centered along the X-axis, having a lower part inserted into the central hole of the base cap, and being provided with a guiding protrusion axially extending from a peripheral wall of the cylinder;

a dispensing nose extending from the cylinder and defining a dispensing channel;

the base cap comprising:

means provided in an inner face of the base cap either for limiting the rotation of the nozzle or for slowing down the rotation of the nozzle;

said guiding protrusion being designed to interfere by direct contact with said means for limiting and for slowing down the rotation of the nozzle;

wherein the pump includes means for reinforcing the guiding protrusion for limiting and for slowing down the rotation of the nozzle wherein said means for reinforcing are located inside the hollow cylinder and reinforce the mechanical structure of walls defining/delimiting the guiding protrusion.

14. The pump actuator according to claim 12, wherein the ring is composed of polypropylene.

* * * * *